United States Patent [19]

Gabriels

[11] Patent Number: 5,074,217

[45] Date of Patent: Dec. 24, 1991

[54] MULTIPLE USE GRENADE

[75] Inventor: André Gabriels, Genk, Belgium

[73] Assignee: Fabrique Nationale Herstal, Herstal, Belgium

[21] Appl. No.: 624,235

[22] Filed: Dec. 7, 1990

[30] Foreign Application Priority Data

Dec. 7, 1989 [BE] Belgium ..... 8901310

[51] Int. Cl.[5] ..... F42B 12/20; F42B 27/00

[52] U.S. Cl. ..... 102/488; 102/482; 102/483; 102/484; 102/487

[58] Field of Search ..... 102/293, 482–488

[56] References Cited

U.S. PATENT DOCUMENTS

| | | | |
|---|---|---|---|
| 1,126,871 | 2/1915 | Roland | 102/483 |
| 1,277,669 | 9/1918 | Viven et al. | 102/484 |
| 1,309,280 | 7/1919 | Farrell, Jr. | 102/483 |
| 1,319,103 | 10/1919 | Miller | 102/483 |
| 1,448,436 | 3/1923 | Day | 102/484 |
| 4,448,129 | 5/1984 | Gabriels | 102/487 |
| 4,715,757 | 12/1987 | Edminster | 102/293 |
| 4,846,070 | 7/1989 | Gabriels | 102/488 |

FOREIGN PATENT DOCUMENTS

| | | | |
|---|---|---|---|
| 516974 | 11/1954 | Belgium . | |
| 880348 | 5/1980 | Belgium . | |
| 905563 | 4/1987 | Belgium . | |
| 0263548 | 4/1988 | European Pat. Off. . | |
| 439507 | 4/1912 | France | 102/483 |
| 1394582 | 4/1965 | France . | |
| 2311270 | 12/1976 | France . | |
| 2492089 | 4/1982 | France . | |
| 104836 | 3/1917 | United Kingdom | 102/483 |
| 129042 | 7/1919 | United Kingdom | 102/483 |

*Primary Examiner*—Harold J. Tudor

*Attorney, Agent, or Firm*—Foley & Lardner

[57] ABSTRACT

Multiple use grenade, characterized in that it principally consists in the combination of a telescopic grenade (2) of a type in itself know, for example a grenade capable of being launched with the assistance of a rifle, and a fuse-plug (1) for a hand grenade, also of a type which is known.

5 Claims, 5 Drawing Sheets

MULTIPLE USE GRENADE

The invention relates to a multiple use grenade, and more especially to a telescopic grenade which is capable of being used either as a grenade destined to be launched with the assistance of a rifle and equipped with a bullet passage, or as a hand grenade.

The invention still more especially relates to a telescopic grenade which is capable of being launched with the assistance of a rifle, for example of the type which is described in Belgian patents no. 880.348, and no. 905.563. These patents describe a telescopic grenade having a head prolonged by a tubular shank and containing an explosive charge as well as a chain firing mechanism for the latter. The aforementioned shank is produced in two telescopic tubular parts of which one part forms one piece with the aforementioned head and with the head holds a first part of the aforementioned chain firing mechanism, while the other part holds the remaining part of the chain firing mechanism. Guiding means are provided in the telescopic grenade and are distributed over the aforementioned two tubular parts in order to assign them a determined angular position, depending on their relative axial position. These grenades, in accordance with the invention, are combined with a fuse-plug for a hand grenade. The fuse-plus consisting in the traditional manner of a head containing a striker held by a safety pin on the one hand, and a lever on the other hand; a percussion cap with which the striker can work together; and a prolongation of the percussion cap by a tube which principally includes a pyrotechnic delayed action charge and a detonator.

According to the invention, the aforementioned fuse-plug can be combined with the telescopic grenade by introducing the tube of the aforementioned fuse-plug into the central tube of the aforementioned grenade, and by fixing the fuse-plug to the aforementioned grenade in a detachable manner, for example by means of a screw thread.

In this manner according to the invention, a multiple use grenade is obtained which can be utilized in following three ways:

in the manner of a telescopic grenade destined to be launched with the assistance of a rifle, the fuse-plug not being applied;

in the manner of a hand grenade in a defensive mode, the fuse-plug being applied to the telescopic grenade, this being in a storage or a transport position, that is in a retracted position;

in the manner of a hand grenade in an offensive mode, the fuse-plug being applied to the telescopic grenade, this being in an extended position.

In fact, when the telescopic grenade is utilized without the fuse-plug, it is expedient to bring it into a firing position, that is in an extended position, and to engage it on the rifle barrel which is utilized for its launching.

When the multiple use grenade is employed as hand grenade in a defensive mode, it is sufficient to remove the safety pin of the fuse-plug which means, after striking the percussion cap, that the detonator of the fuse-plug makes the grenade which is in a retracted position explode, and hence fragmentation of the telescopic grenade occurs.

When the multiple use grenade is employed as hand grenade in an offensive mode, it is sufficient to remove the safety pin of the fuse-plug which means, after striking the percussion cap, that the detonator of the fuse-plug makes the grenade which in an extended position explode, which means that no fragmentation of the telescopic grenade is produced.

In a preferred embodiment the multiple use grenade according to the invention principally consists of a telescopic grenade and a fuse-plug for a hand grenade, the latter forming one piece with the telescopic grenade in a detachable manner, preferably by a screw thread.

In order to better show the characteristics according to the present invention, a preferred embodiment is described hereafter, as an example and without any restrictive character, with reference to the enclosed drawings in which:

FIG. 1 represents, a fuse-plug 1 for a hand grenade, in itself known, on the one hand, and a telescopic grenade 2 which can be launched with the assistance of a rifle, equally known, on the other hand.

Figure 1:
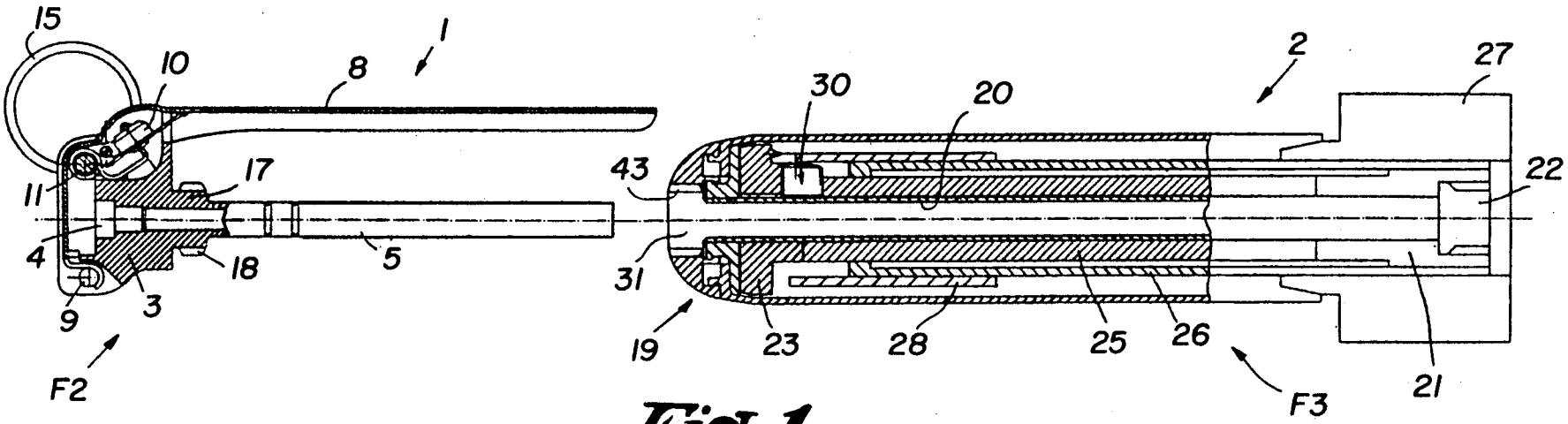
FIG. 1 represents a dismantled view of the principal constituent parts of the multiple use grenade according to the invention.
Figure 2:
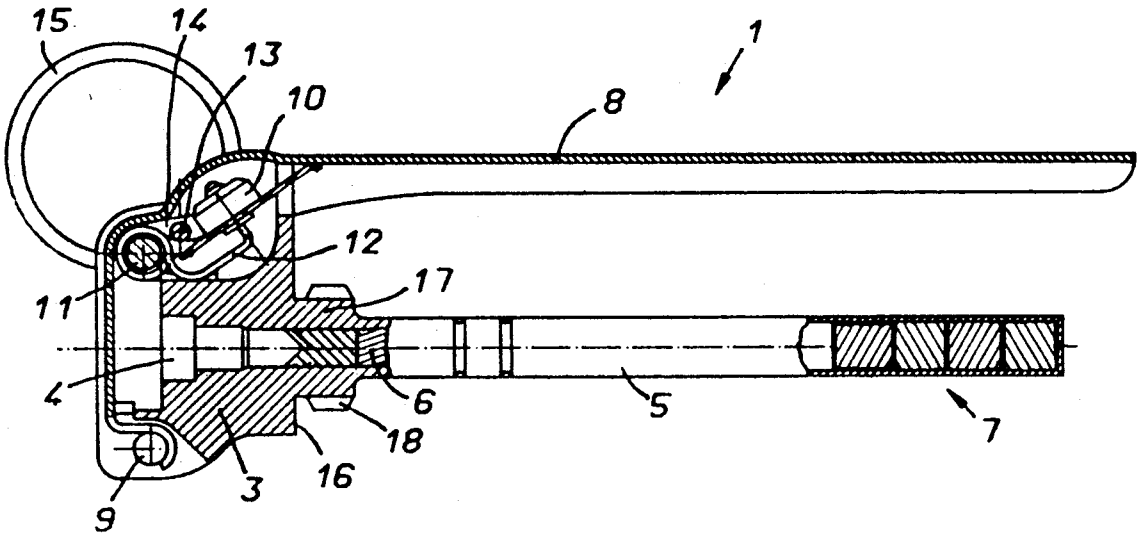
FIGS. 2 and 3 represent, on larger scale the parts indicated respectively by F2 and F3 in FIG. 1.
Figure 3:
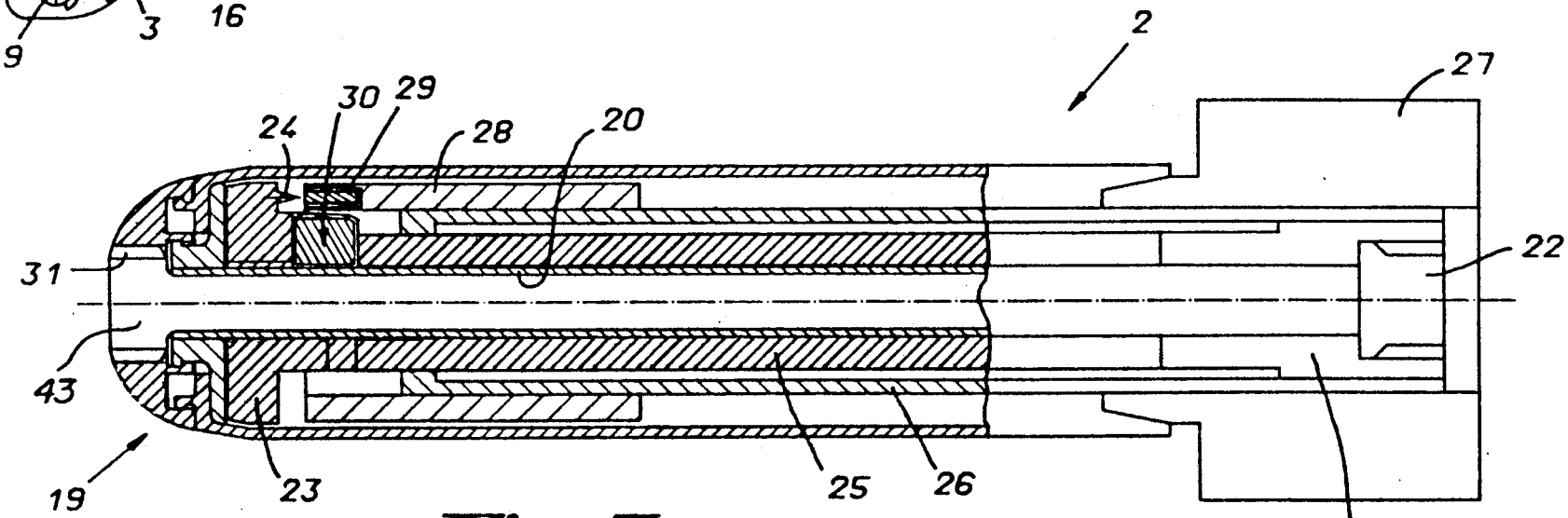

The fuse-plug 1 consists in this case of a head 3 in which a percussion cap 4 is situated, the head 3 being prolonged by a tube 5 in which a pyrotechnic delayed action charge 6 and a detonator 7 are lodged.

In a known manner, the head 3 is provided with a lever 8 which can pivot around an axle 9 and a striker 10 mounted in a rotatable manner around an axle 11. The striker 10 is permanently being pulled by a spring 12 which attempts to make the striker 10 swing towards the percussion cap 4. The swinging of the aforementioned striker 10 is avoided by a safety pin 13 traversing at the same time the lever 8, the support 14 of the striker 10 and the head 3. The safety pin 13 is capable of being removed by means of a pulling ring 15, which is fixed to one extremity of the safety pin 13.

On its rear part 16, the head 3 shows a part 17 widened in relation to the tube 5. This part 17 is provided with a screw thread 18.

The second principal part of the multiple use grenade according to the invention is constituted by a telescopic grenade 2 which is principally constituted by a head 19 to which is fixed a sheath 20 of which the other extremity is provided with a sleeve 21 in which the bullet passage 22 is fixed creating a passage 43 which extends through the grenade.

The head 19 comprises around the sheath 20 a plate 23 provided with a percussion pin 24.

Around the sheath 20 and between the plate 23 and the sleeve 21 a body 25 is provided constituting the explosive charge of the projectile and around this charge 25 is provided a tube 26 bearing the fin 27 on its posterior extremity and on its anterior extremity a housing 28.

The housing 28 has a notch in which a detonator 29 is lodged, which can present itself opposite a relay 30 which is pressed into the explosive charge 25.

The head 19 of the telescopic grenade 2 also has a screw thread 31 with which the threaded part 18 of a fuse-plug 1 can be screwed into connection.

It is obvious that the fuse-plug 1 can be of any type, mechanical or electronic.

It is also evident that the attachment of the fuse-plug 1 to the telescopic grenade can be realized in any manner other than by a screw thread, as for example by clipping 40, bayonet catch 41 or other similar means.

The multiple use grenade according to the invention can be employed in the following way.

Figure 4:
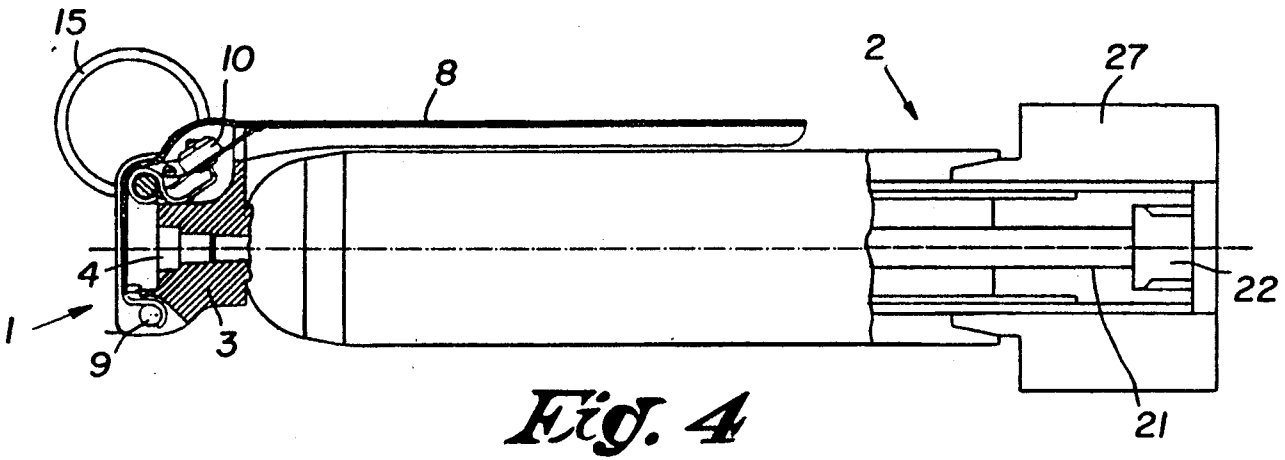
FIG. 4 represents the cooperation of the two constituent parts of the multiple use grenade according to the invention.

By screwing the fuse-plug 1 into the telescopic grenade 2 the position as represented in FIG. 4 is obtained. In this position the multiple use grenade is in such a position that it can be employed in a defensive manner, to ensure fragmentation of the telescopic grenade 2.

Figure 6:
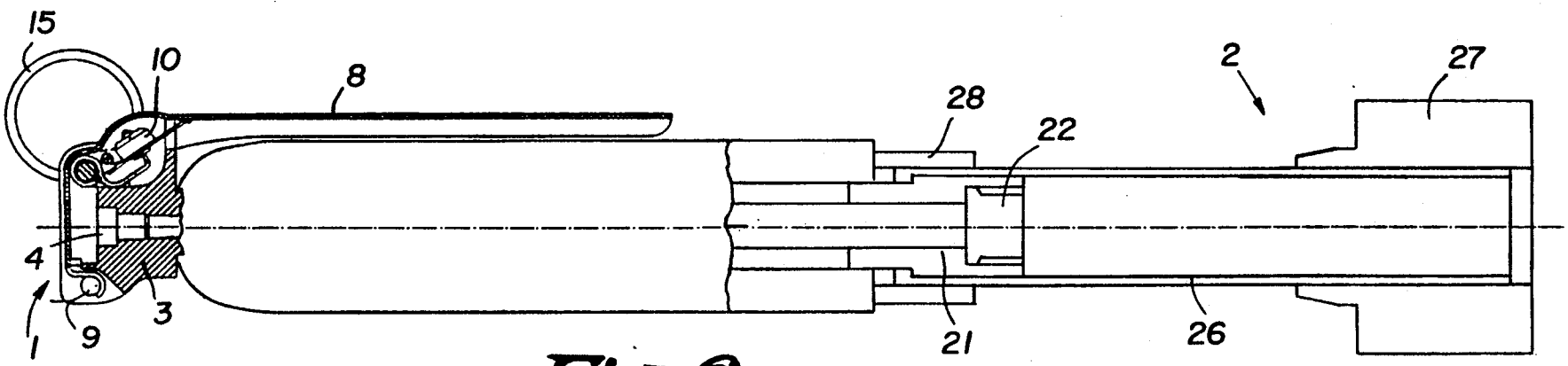
FIG. 6 represents a similar view to that from FIG. 4 of the multiple use grenade which is in its extended position.
Figure 5:
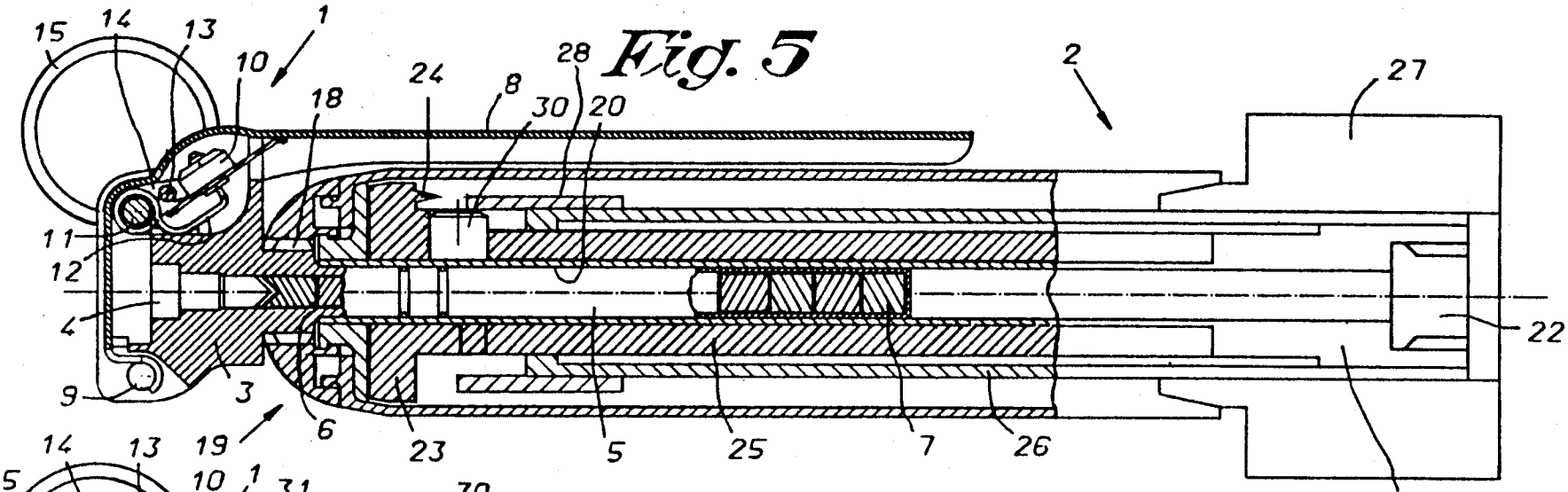
FIG. 5 represents, with more details, an enlargement of FIG. 4.
Figure 7:
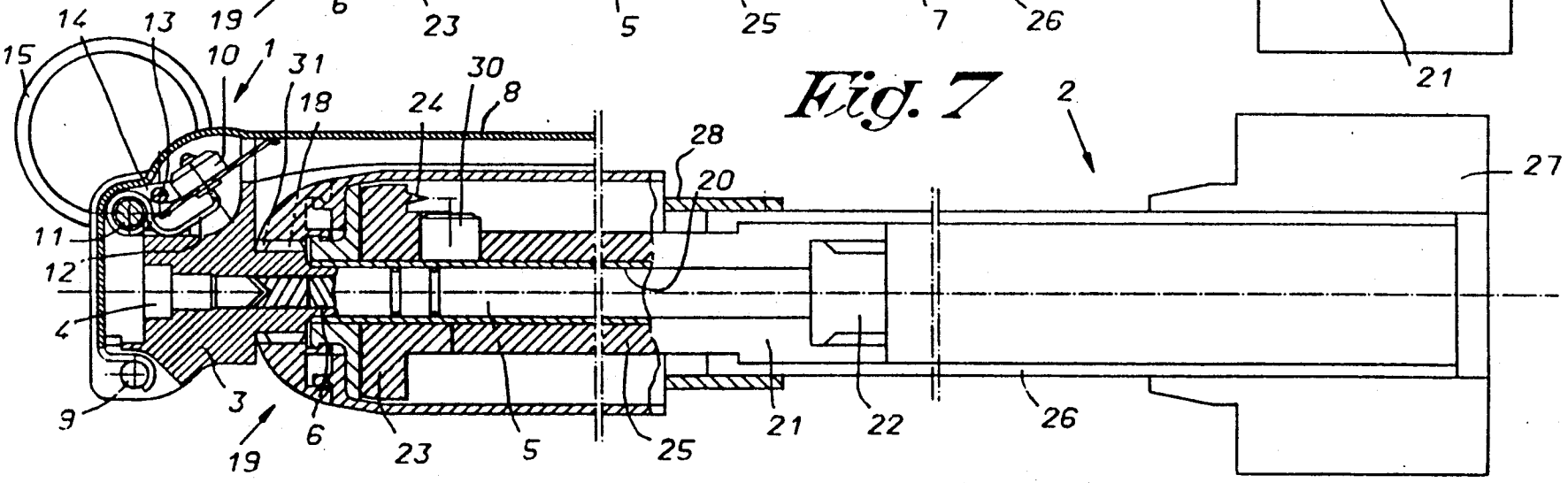
FIG. 7 represents with more details an enlargement of FIG. 6.
Figure 9:
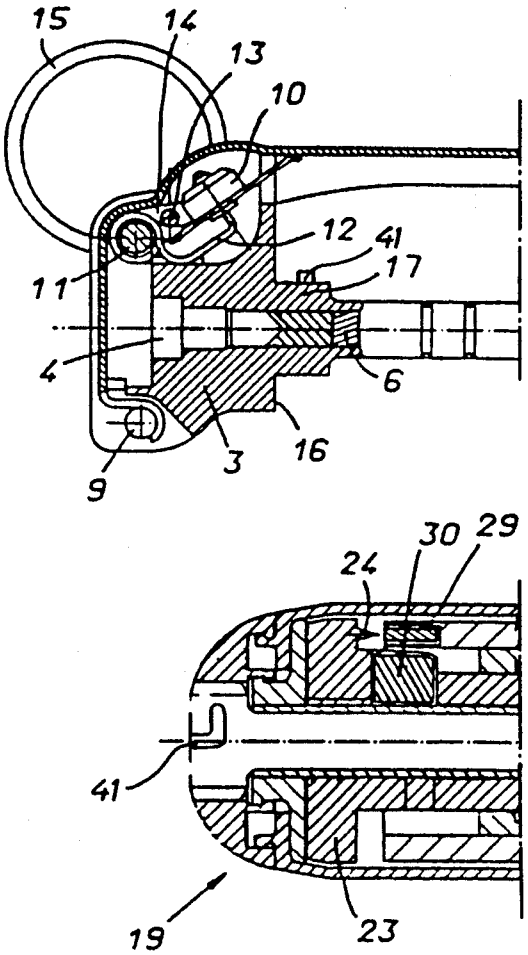
FIG. 9 shows a portion of a third embodiment of the two constituent parts which shows the bayonet connection.
Figure 8:
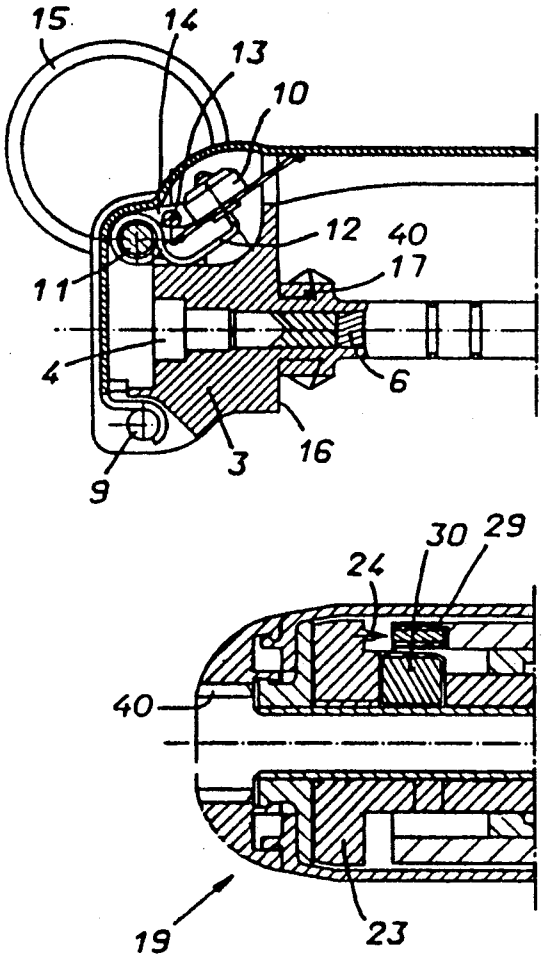
FIG. 8 shows a portion of a second embodiment of the two constituent parts which shows the clip connection.

In the position as represented in FIG. 6, that is with the telescopic grenade 2 in its extended position, the multiple use grenade according to the invention is in a position to be employed in an offensive way, that is without causing fragmentation of the telescopic grenade 2.

Both in the position from FIG. 4 and in the position from FIG. 6, the multiple use grenade functions in the following manner.

At the commencement of the operation, either in the position from FIG. 4, or in the position from FIG. 6, his operator holds the grenade in the hand, around the lever 8. The moment he pulls out the safety pin 13, by pulling on the pulling ring 15, the lever is in such a position that it will turn, under the influence of the spring 12, around the pivot 9, the moment the multiple use grenade 1, 2 is released or launched.

At the moment, the lever 8 will release the striker 10 which will turn around the pivot 11 and will come and strike the percussion cap 4 so that the latter ignites the pyrotechnic delayed action charge 6 and subsequently the detonator 7 which finally causes the explosive charge 25 of the telescopic grenade 2 to explode. The difference between FIGS. 4 and 6 is that in the FIG. 4 defensive position, the total fragmentation of the body of the telescopic grenade 2 will occur, whereas in the offensive position of FIG. 6, the telescopic grenade 2 is in an extended position, and therefore no fragmentation of the telescopic grenade 2 will occur.

Notwithstanding the possibility of employing the multiple use grenade as a hand grenade, in either a defensive mode or in offensive mode, the possibility nevertheless remains of employing the telescopic grenade 2 as a grenade which is capable of being launched by a rifle.

In fact, it is expedient for this objective to remove the fuse-plug 1 and to engage, in a known manner, the telescopic grenade 2 in its extended position on the extremity of the barrel of a rifle in order to achieve the launching of the telescopic grenade 2 by means of a bullet fired by the rifle.

The telescopic grenade, once it has left the rifle, will retake its retracted position in such a way that at the time of impact, the detonator 29 will enter into brusque contact with the striker 24 to ensure that the charge 27 of the grenade explodes via the relay 30.

It is evident that many modifications can be made to the multiple use grenade as described above without departing from the scope of the invention.

I claim:

1. A multiple use grenade comprising:

a telescopic rifle grenade having a head and a tubular tail and containing an explosive charge and a firing chain in communication with said explosive charge, said tail comprising first and second telescopically related tubular parts, said first telescopic tubular part being fixed to said telescopic grenade head and including a first part of said firing chain, and said second telescopic tubular part including the remaining parts of said firing chain, said telescopic grenade head being traversed by a central passage extending into said first tubular telescopic part, said explosive surrounding said central passage in said first tubular telescopic part;

a fuse-plug for a hand grenade comprising a head, a percussion cap mounted in said fuse-plug head, and a tube prolongating said hand grenade head and having disposed therein a pyrotechnic delayed action charge and a detonator; and releasably attaching means for attaching the fuse-plug to said telescopic grenade head such that said tube of said fuse-plug extends inside said first tubular telescopic part in said central passage;

whereby when said telescopic grenade is to be rifle launched, said fuse-plug is detached from said telescopic grenade head and when said telescopic grenade head is to be hand launched, said fuse-plug is attached to said telescopic grenade head.

2. A multiple use grenade according to claim 1, wherein said means for releasably attaching the fuse-plug comprises a screw thread around said passage in said telescopic grenade and a matching screw thread on said fuse-plug head.

3. A multiple use grenade according to claim 1, wherein said means for releasably attaching said fuse-plug comprises a clip connection.

4. A multiple use grenade according to claim 1, wherein said means for releasably attaching said fuse-plug comprises a bayonet connection.

5. A multiple use grenade according to claim 1, wherein said fuse-plug comprises a lever pivotably mounted on the fuse-plug head, a striker disposed inside said fuse-plug head, and a removable safety pin traversing said lever and said fuse-plug head.

* * * * *